United States Patent [19]

Stearns et al.

[11] Patent Number: 4,984,810

[45] Date of Patent: Jan. 15, 1991

[54] TREADMILL

[75] Inventors: Kenneth W. Stearns; John K. McGee, both of Houston, Tex.

[73] Assignee: Stearns & McGee, Houston, Tex.

[21] Appl. No.: 379,693

[22] Filed: Jul. 13, 1989

Related U.S. Application Data

[63] Continuation of Ser. No. 125,112, Nov. 25, 1987, abandoned.

[51] Int. Cl.[5] ..... A63B 22/02

[52] U.S. Cl. ..... 272/62; 272/70

[58] Field of Search ..... 272/69, 70, 70 A

[56] References Cited

U.S. PATENT DOCUMENTS 1,824,406 9/1931 Petersime ..... 272/69
4,664,371 5/1987 Viander ..... 272/69

FOREIGN PATENT DOCUMENTS 2528414 5/1976 Fed. Rep. of Germany ..... 273/53
3601184 7/1987 Fed. Rep. of Germany ..... 272/69
1565617 5/1969 France ..... 272/69

*Primary Examiner*—Richard J. Apley
*Assistant Examiner*—D. F. Crosby
*Attorney, Agent, or Firm*—Dodge, Bush & Moseley

[57] ABSTRACT

A treadmill is disclosed having a belt system carried by a platform structure. The platform structure is pivotally mounted at its rear end to a base structure. The platform is supported at its forward end by a shock absorber/-spring system which provides a damped resilient response of the belt and platform when a person's foot lands during running or walking. Carrying the belt system by the platform structure enables the endless belt of the belt system to be maintained closely above the platform even when a runner's foot lands on it with heavy impact. The support of the platform immediately below the belt eliminates lateral slack in the belt which could possibly result in injury to a walker or runner due to an uneven landing surface.

17 Claims, 2 Drawing Sheets

TREADMILL

This application is a continuation, of application Ser. No. 125,112, filed Nov. 25, 1987, now abandoned.

BACKGROUND OF THE INVENTION

1. Field of the Invention

This invention relates in general to treadmills and in particular to an improved shock absorbing treadmill which provides in use reduced landing forces to a runner's foot while simultaneously providing a substantially flat, stable running surface.

2. Description of the Prior Art

The art has provided treadmills in response to demand of walkers, joggers and runners and the medical profession for a device which may be used, especially indoors, for exercise where outdoor walking, jogging or running is not enjoyable or practical. A problem with running or jogging as an exercise to strengthen the cardiovascular system relates to the possibility of impact injury to feet, ankles and knees caused by the force of the runner's foot striking an unyielding surface, such as street pavement. Prior treadmill designs have recognized this problem and have attempted to solve it in a number of ways. For example, U.S. Pat. No. 4,614,337 of Schomenberger discloses a treadmill with a flat top surface covered with a resilient surface such as foam rubber, carpeting or the like. Another example is U.S. Pat. No. 4,548,405 to Lee et al which discloses a trampoline like top surface for a treadmill.

U.S. Pat. No. 4,350,336 to Hanford provides a treadmill having a frame to which rollers are attached which carry an endless tread belt. The belt moves above a platform disposed beneath the running portion of the belt. The platform is supported by longitudinal platform rails which are supported at one end by a lateral frame member which is secured to the frame. The platform is supported at its other end by shock absorbing members attached to the longitudinal rails. The shock absorbing member may be moved longitudinally with respect to the frame. The shock absorbing member absorbs shock directly of the platform as a runner exercises on the treadmill belt above. The platform flexes longitudinally as it pivots at one end and is shock absorbingly supported at its other end.

Although an admirable improvement in the art of shock absorbing treadmills, the Hanford treadmill does not provide an adequately stable running surface. The platform is shock absorbingly supported, but the endless tread belt is not. The belt rollers are both supported directly by the frame. As a result, the belt runs over the platform with sufficient slack in it to allow the platform beneath it to move downwardly in response to the impact of a runner's foot. The slack in the belt can cause an uneven lateral surface for succeeding foot landings, possibly leading to twisted ankles, knees, etc.

IDENTIFICATION OF OBJECTS OF THE INVENTION

It is therefore an object of the invention to provide a stable flat running surface for a treadmill having a shock absorbing means to cushion the impact of a runner's foot.

It is another object of the invention to provide a treadmill having an endless belt which is firmly supported by a platform, and yet the platform and the endless belt and its drive means are shock absorbingly supported.

SUMMARY OF THE INVENTION

The objects identified above, as well as other advantages and features of the invention are provided in an exercise treadmill which includes a belt system including forward and rear rollers and an endless belt placed about such rollers. The belt has an upwardly exposed operative section adapted for running or walking. A belt support platform structure having forward and rear ends provides support for the belt system. The platform structure partially underlies the operative section of the belt and carries the forward roller of the belt system. The rear end of the platform structure is pivotally supported to a base structure near its rear end. The rear roller of the belt system is mounted near the rear end of the platform such that it is free to rotate with the movement of the endless belt. The mounting of the rear roller is preferably to the base structure, but alternatively, may be carried by the platform structure near its end. The platform structure is supported at its forward end by a shock absorber/spring system, preferably linked to the base structure, or alternatively, simply to the ground or floor on which the treadmill is placed. The shock absorber/spring support of the platform structure reduces impact forces on a runner's foot. Such impact force reduction is a result of the downward movement of the platform after the runner's foot strikes the belt above the platform The platform's downward movement, opposed by the spring(s) of the system, is dampened by the shock absorber(s) of the system. As the runner strides to take another step, the platform and the belt system carried by it, returns to a non-loaded position. Because of the close proximity of the operative section of the endless belt to the platform, there is no slack or sagging of the belt which could cause a runner's foot, ankle or leg to twist upon landing of his foot on the belt.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which.

DESCRIPTION OF THE INVENTION

Figure 1:
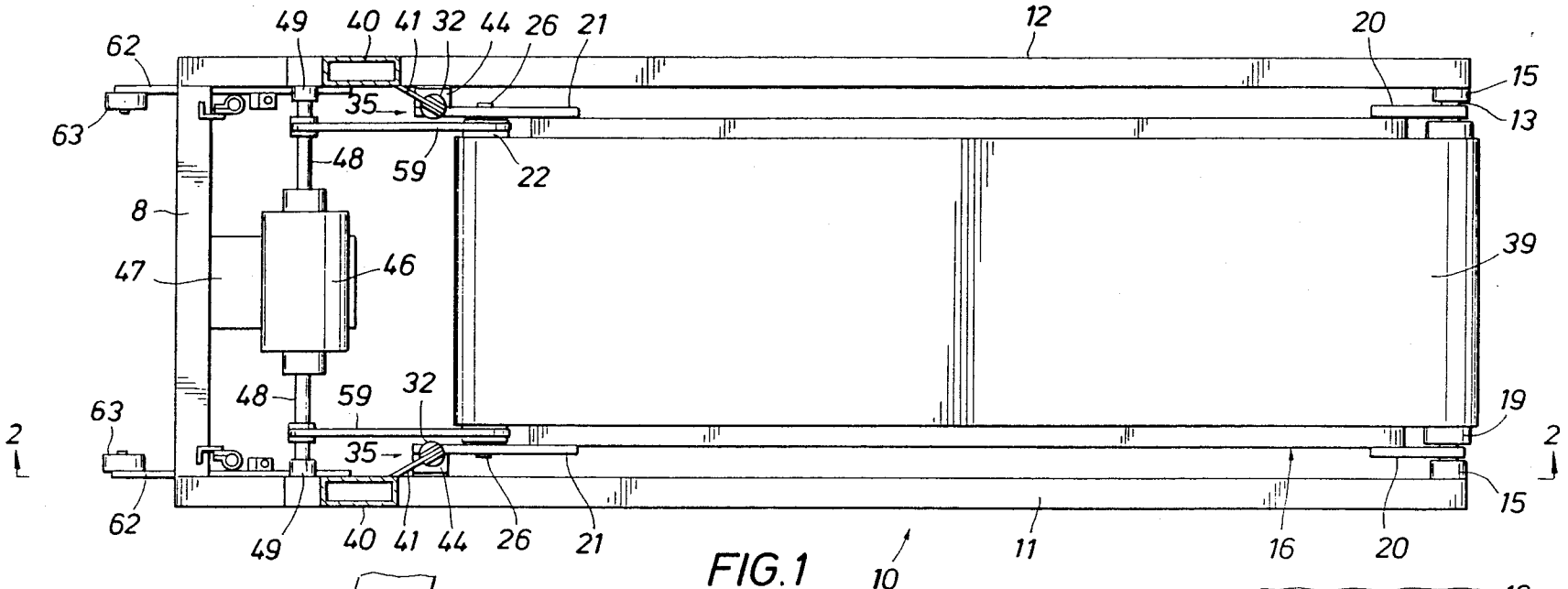
FIG. 1 is a plan view of a treadmill according to the invention which incorporates a shock absorber/spring system.
Figure 2:
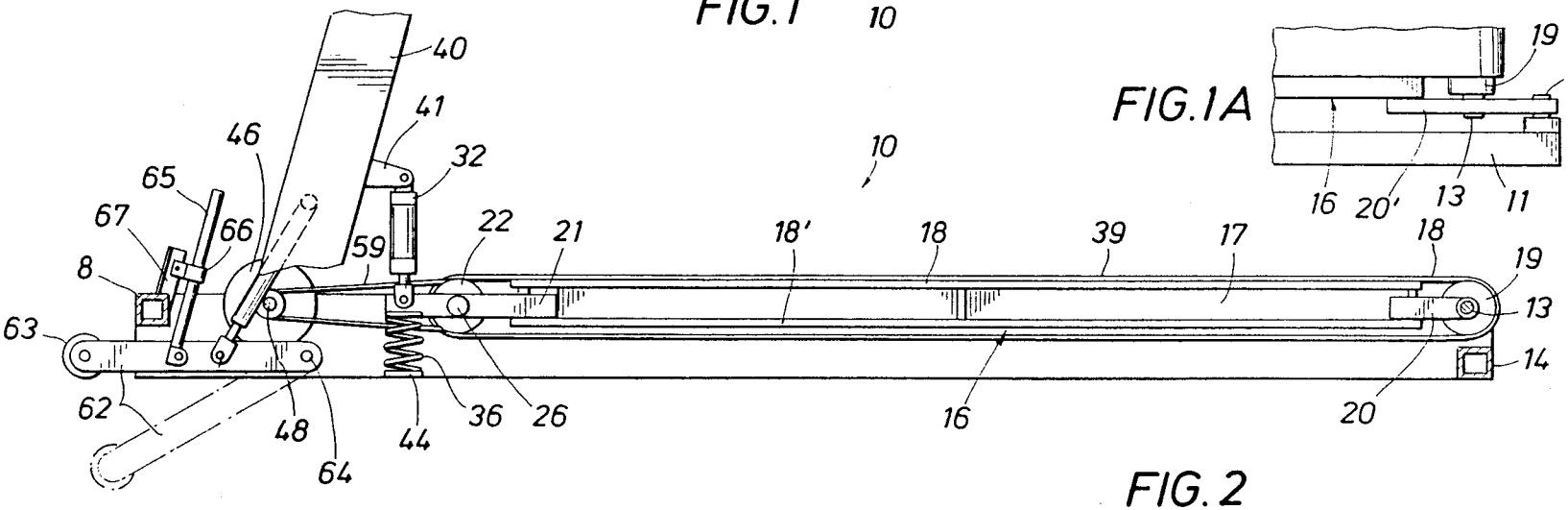
FIG. 2 is a sectional view taken along lines 2—2 of FIG. 1 which further illustrates details of construction of the treadmill with a shock absorber/spring system.

The treadmill 10 of FIGS. 1 and 2 includes a support base having a pair of spaced longitudinal rails 11 and 12. The rails 11 and 12 extend the full length of the apparatus. They are normally placed horizontally on the floor although one end of them may be elevated as will be described below. The rails 11 and 12 are joined by cross support members 8 and 14 and others as appropriate.

The longitudinal rails 11, 12 have a pair of inwardly directed shaft bearing members 15 in which ends of shaft 13 are placed and are free to turn. Rear connection members 20, pivotally connected to shaft 13, are rigidly connected to side members 17 of platform structure 16. Rear roller 19 is disposed about shaft 13 and rotates with it with respect to the base.

The platform structure 16 is generally rectangular in shape, constructed of lightweight material, and preferably includes a pair of longitudinal reinforcing side members 17 and rectangular upPer and lower decking members 18, 18'.

Forward connection members 21, rigidly connected to side members 17 of platform structure 16, carry a shaft 26 to which forward roller 22 is connected. Roller 22 and shaft 26 are free to rotate with respect to connection members 21 and platform structure 16.

An endless belt 39 is placed about rollers 22 and 19 and has sufficient longitudinal tension to create negligible vertical slack between the longitudinally spaced rollers. The underside of belt 39 is constructed to pass or slide freely over the upper side of upper decking member 18.

The platform structure 16, and treadmill system (including rollers 22 and 19 and belt 39) are resiliently supported at its forward end by shock absorber/spring system 35 shown in the plan view of FIG. 1. FIG. 2 shows the construction of such system 35 as included on both lateral sides spring 36 secured at its top end to forward connection member 21 and at its bottom end to longitudinal rails 11 and 12 by means of plates 44. The base, including rails 11, 12 are of course placed on the ground or floor. Shock absorbers or dampers 32 are connected between forward connection members 21 and vertical members 40, which in turn are connected to support base longitudinal rails 11 and 12. Links 41 connect shock absorbers 32 to vertical members 40. Vertical members 40 may also support a control panel, hand rails and the like (not illustrated).

Shock absorbers or dampers 32 introduce a frictional constraint K proportional to the velocity of the mass that is free to move vertically; in this case, the vertically movable part is the platform structure 16, and at least part of the belt system (belt 39 and roller 22). The platform structure 16 pivots about rear shaft 13. The shock absorber 32 in the preferred embodiment of the invention is constructed to offer no resistance to downward movement of structure 16 for the first one-half inch of travel and to introduce frictional constraint proportional to velocity thereafter.

A motor 46 is supported from cross support member 8 by bracket 47 and includes two coaxial output shafts 48 journaled in bearings 49 secured to support base longitudinal rails 11 and 12. Belts 59 are placed about sheaves on motor output shafts 48 and on forward roller shaft 26 to drive roller 22 and endless belt 39.

The forward end of treadmill 10 may be elevated by pivot legs 62 which may be pivoted about pins 64 to cause the support base to be horizontal with the ground or floor or cause the forward end to be raised The phantom line illustration of pivot leg 62 illustrates that it can be pivoted downwardly with respect to point 64, thereby raising the forward end of the treadmill, causing the user of it to be running, walking, etc. on an upward grade Support rods 65, attached to pivot leg 62, may be clamped by clamp 66 at different positions. Clamp 66 is connected to cross support member 8 by links 67. Accordingly, support rods 65 may hold pivot legs 62 at a desired angular position. Wheels 63, affixed to the ends of legs 62, aid in moving the treadmill along the floor or ground.

The embodiment of the invention as illustrated in FIGS. 1 and 2 is used as an exercise treadmill where a runner operates motor 46 to cause endless belt 39 to move across the upper surface of decking 18 of platform structure 16. With each step, the runner lands on endless belt 39 and decking 18 which imparts a downward force to forward connection member 21 and to the springs 36 and shock absorbers 32 as forward roller 22, and platform structure 16 pivots about shaft 13. The spring 36 opposes the downward force proportional to the downward distance of movement of the forward end of the platform structure 16. The shock absorber 32 opposes downward force proportional to the velocity at which the mass is moving The mass itself opposes the downward force proportional to the acceleration at which it is moving. By proper selection of the mass of the system, the spring constant of the spring 36, and the friction constant of shock absorber 32, a damped response of the treadmill can be achieved in response to the landing force of a runner's foot on belt 39 and platform structure 16. Of course, the treadmill system returns to its original position, with a damped response in the opposite direction when the runner takes another stride.

The result is less impact force on the runner's feet, ankles and limbs, because on landing with the treadmill, his foot meets a yielding surface which moves downwardly with a damped response. In other words, his foot decelerates over a longer time period—determined by the response time constant of the mass, spring constant, and friction constant of the shock absorbers. This longer time period is in contrast to the situation where the runner's foot lands on an unyielding surface, such as concrete pavement, where the deceleration of the runner's foot is much shorter and the shock force of impact is imparted to his foot, ankles and legs.

An advantageous feature of the invention is that the decking 18 of platform structure 16 is maintained in close proximity to the belt while the belt moves or slides freely above decking 18. This proximity of belt 39 and decking 18 prevents the belt 39 from sagging or yielding as the runner's foot lands on the belt 39 and the decking 18 below. A stable running surface, that is, a taut belt with the decking 18 immediately below it, presents a laterally stable running surface for the prevention of turned or twisted feet, ankles or knees of the runner.

Figure 3:
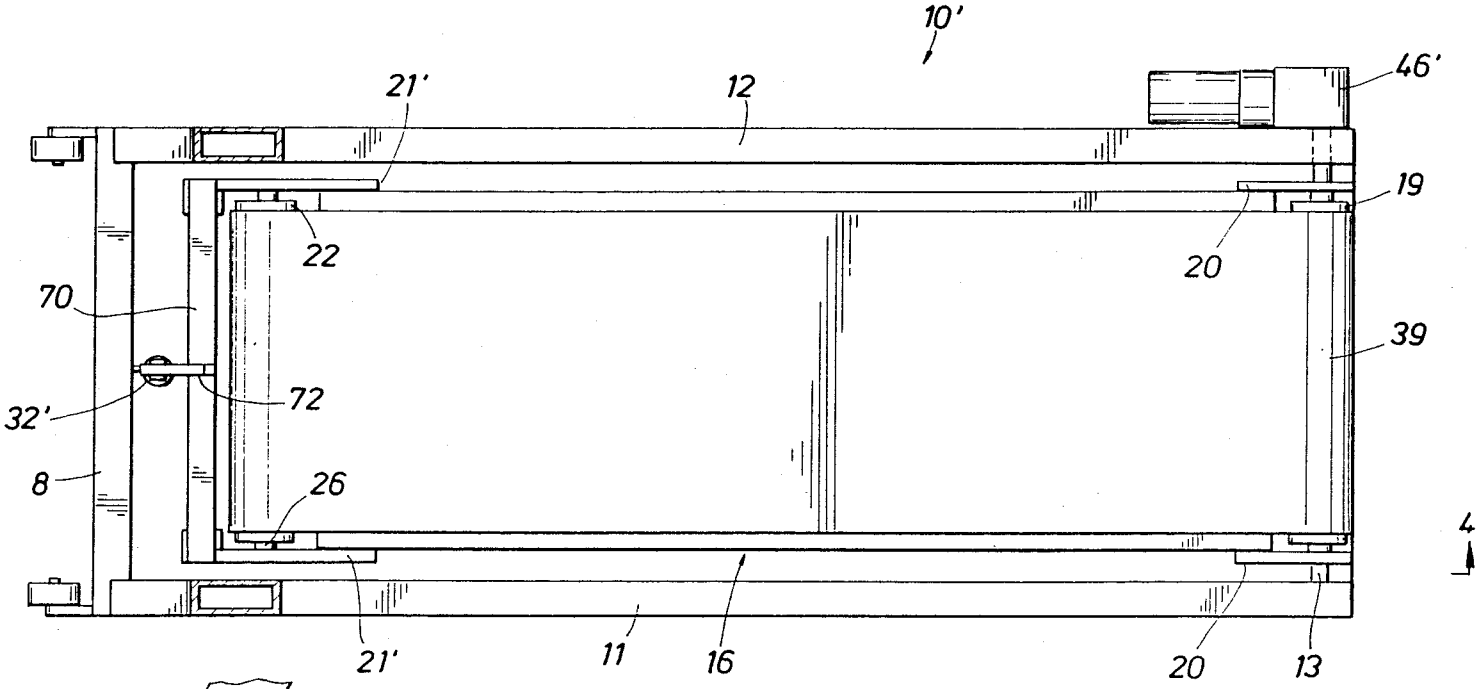
FIG. 3 is a plan view of an alternative treadmill according to the invention incorporating a modified shock absorber/spring system and a treadmill drive system connected to its rear roller.
Figure 4:
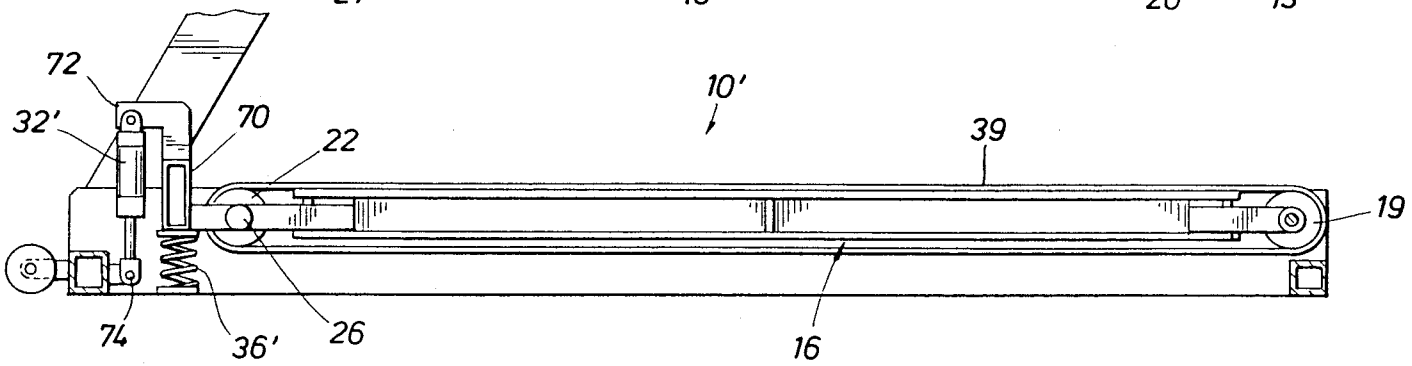
FIG. 4 is a sectional view taken along the line 4—4 of FIG. 3.

An alternative embodiment of the invention incorporating a shock absorbing system is illustrated in FIGS. 3 and 4. In this embodiment, the forward connection members 21' support shaft 26 of forward roller 22 as in the embodiment of FIG. 1, but members 21' are each connected to a cross member 70 which is supported by a single spring 36' (which may be supported by the floor or a connecting member attached to rails 11 or 12 (not shown)) A single shock absorber or damper 32' may be connected to cross member 70 via linkage 72 and to base cross member 8 via linkage 74. The treadmill endless belt 39 may be driven by rear mounted motor 46', the output shaft of which drives shaft 13 to which rear roller 19 is rigidly attached.

Figure 1A:
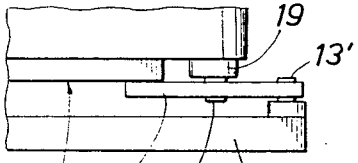
FIG. 1A is a partial plan view of the rear of the treadmill which illustrates the rear of the treadmill being mounted to or carried by a portion of the platform structure which is pivotally mounted to the base of the treadmill.

The description of preferred embodiments of the invention described above should be viewed as illustrative of the invention and not limitative. Minor structural changes from the treadmills illustrated and described above may occur to one skilled in the treadmill art. For example, the support base may be modified such that longitudinal rails 11, 12 are split into forward and rear sections to provide forward and rear support for the platform structure 16 without extending the entire longitudinal distance of the treadmill. The rear roller of the belt system may be carried by the rear platform structure rather than mounted to the support base. As illustrated in FIG. 1A, roller 19 is mounted or carried by shaft 13' which may rotate in member 20' of platform structure 16. Member 20' is pivotally supported by shaft 13' which is connected to base 11. The spring and shock absorber of the front mounting for the platform structure could be connected directly to floor or ground on which the treadmill is placed. Gear drives could be used to drive either the front or rear rollers rather than the preferred belts as illustrated. Accordingly, the only limitations to the invention are incorporated in the claims which follow.

What is claimed is:

1. An exercise treadmill comprising a base having forward and rear ends, pivot means disposed near the rear end of said base, a belt system including forward and rear rollers and an endless belt placed about said rollers, said belt having an upwardly exposed operative section and a downwardly exposed return section, a belt support platform structure having forward and rear ends, said platform structure disposed between said upwardly exposed operative section and said downwardly exposed return section of said belt system, said platform structure including a decking member operably arranged such that said operative section of said belt slides over said decking member when said belt system is in operation, said decking member providing support to a runner's foot as it lands on said upwardly exposed operative section of said belt, said platform structure including forward connection member means connected to said forward end of said decking member for carrying said forward roller of said belt system, said platform structure including rear connection member means connected to said pivot means for pivotally carrying said platform structure with respect to said rear end of said base, means for mounting said rear roller of said belt system to said base near the rear end of said platform structure, and shock absorbing platform support means including in combination a spring means and a separate damping means operable between said forward member connection means and said base for supporting said platform structure and aid belt system and reducing impact forces of a runner while running on said operative section of said belt.

2. The treadmill of claim 1 wherein said platform support means includes spring means connected between said base and said forward end of said platform structure, and said separate damping means connected between said base and said forward end of said platform structure.

3. The treadmill of claim 1 wherein said platform support means includes on each lateral side of the forward end of said platform structure a spring connected between said base and said platform and said separate damping means connected between said base and said platform structure.

4. The treadmill of claim 1 further comprising powered means for rotating said rear roller.

5. The treadmill of claim 4 wherein said powered means comprises, a drive motor mounted on said base; and drive train means interconnecting said motor and said rear roller.

6. The treadmill of claim 1 further comprising powered means for rotating said forward roller.

7. The treadmill of claim 6, wherein said powered means comprises, a drive motor mounted on said base, and drive train means interconnecting said drive motor with said forward roller.

8. The treadmill of claim 1, further comprising, powered means for rotating one of the forward or rear rollers, said powered means including, a drive motor mounted on said base, and a drive train system interconnecting said drive motor and the driven roller.

9. The treadmill of claim 1, further comprising, elevation means for elevating the forward end of the exercise treadmill to position said endless belt at a desired angle of inclination wherein said elevation means are mounted on said forward end of said base and are extendable downwardly to elevate the forward end of the base.

10. An exercise treadmill comprising a base, a belt system including forward and rear rollers and an endless belt placed about said rollers, said belt having an upwardly exposed operative section and a downwardly exposed return section, a belt support platform structure having forward and rear ends, said platform structure disposed between said upwardly exposed operative section and said downwardly exposed return section, said platform structure including a decking member operably arranged such that said operative section of said belt slides over said decking member when said belt system is in operation, said decking member providing support to a runner's foot as it lands on said upwardly exposed operative section of said belt, said platform structure carrying said forward and rear rollers of said belt system, supporting means for pivotally supporting said platform structure to said base near the rear end, and shock absorbing platform support means including a spring means and a discrete damping means, said platform support means connected between said forward end of said platform structure and said base for supporting said platform and said belt system and reducing impact forces of a runner while running on said operative section of said belt.

11. The treadmill of claim 10 wherein:

said spring means includes a spring on each lateral side of the forward end of said platform structure; and said damping means includes a damper on each lateral side of the forward end of said support platform structure connected between said base and said platform structure.

12. The treadmill of claim 10 further comprising, motor means for rotatably driving one of the forward or rear rollers of said belt system, said motor means comprising a drive motor mounted on said base; and drive train means interconnecting the motor and the driven roller of said belt system.

13. The treadmill of claim 10 further comprising, elevation means for elevating the forward end of the exercise treadmill to position said endless belt at a desired angle of inclination wherein said elevation means are mounted on said forward end of said base and are extendable downwardly to elevate the forward end of the base.

14. An exercise treadmill comprising, a base, a belt system including forward and rear rollers and an endless belt placed about said rollers, said belt having an upwardly exposed operative section and a downwardly exposed return section, a belt support platform structure having forward and rear ends, said platform structure disposed between said upwardly exposed operative section and said downwardly exposed return section of said endless belt, said platform structure including a substantially smooth decking structure at least partially underlying said operative section of said belt, said decking structure operably arranged with respect to said endless belt such that said operative section of said belt slides over said decking member when said belt system is in operation, said decking member providing support to a runner's foot as it lands on said upwardly exposed operative section of said belt, said platform structure carrying said forward roller of said belt system, supporting means for pivotally supporting said platform structure to said base near the rear end, and means connected to said base for supporting said belt support platform structure near its front end with spring and damping elements which, in combination with the mass of said platform structure, impart a damped response of the belt support platform structure in response to impact forces of a runner while running on said operative section of said belt.

15. The treadmill of claim 14 wherein said spring and damping elements are discrete.

16. The treadmill of claim 15 further including means for mounting said rear roller of said belt system to said base near the rear end of said platform structure.

17. The treadmill of claim 15 further including means for mounting said rear roller of said belt system to said belt support platform structure near its rear end.

* * * * *